US006945144B1

(12) United States Patent
Cutler et al.

(10) Patent No.: US 6,945,144 B1
(45) Date of Patent: Sep. 20, 2005

(54) TORQUE WRENCH WITH FINITE PLURALITY OF SELECTABLE TORQUE VALUES

(75) Inventors: Brian Cutler, Rowland Heights, CA (US); Jaye Kurtovic, Walnut, CA (US); Gary Keefe, West Hills, CA (US); David Sarabia, Azusa, CA (US); Denny Atkinson, Pomona, CA (US)

(73) Assignee: Snap-on Incorporated, Pleasant Prairie, WI (US)

( * ) Notice: Subject to any disclaimer, the term of this patent is extended or adjusted under 35 U.S.C. 154(b) by 0 days.

(21) Appl. No.: 10/368,909

(22) Filed: Feb. 17, 2003

(51) Int. Cl.[7] ..... B25B 23/159
(52) U.S. Cl. ..... 81/483; 81/478; 81/480
(58) Field of Search ..... 81/483, 478, 480, 81/481, 467, 473, 476

(56) References Cited

U.S. PATENT DOCUMENTS

| | | | | |
|---|---|---|---|---|
| 3,165,014 A | | 1/1965 | Grabovac | 81/52.5 |
| 4,403,531 A | | 9/1983 | Bailey et al. | 81/483 |
| 4,467,678 A | | 8/1984 | Lindholm | 81/483 |
| 4,485,703 A | * | 12/1984 | Grabovac et al. | 81/483 |
| 4,655,104 A | * | 4/1987 | Blattner | 81/483 |
| 4,870,879 A | | 10/1989 | Shieh | 81/483 |
| 5,129,293 A | | 7/1992 | Larson et al. | 81/483 |
| 5,546,816 A | * | 8/1996 | Jansson et al. | 73/862.21 |
| 5,557,994 A | | 9/1996 | Nakayama | 81/478 |
| 5,662,012 A | | 9/1997 | Grabovac | 81/478 |
| 5,859,371 A | * | 1/1999 | Hsieh | 73/862.23 |
| 5,890,406 A | | 4/1999 | Thorn | 81/468 |
| 5,904,459 A | | 5/1999 | Prathap et al. | 411/6 |
| 6,062,115 A | | 5/2000 | Bares et al. | 81/481 |
| 6,082,941 A | | 7/2000 | Dupont et al. | 411/7 |
| 6,439,064 B1 | | 8/2002 | Fanguy | 73/862.25 |
| 6,463,834 B2 | * | 10/2002 | Kemp et al. | 81/483 |
| 2001/0022121 A1 | | 9/2001 | Gambarini | 81/483 |
| 2002/0040628 A1 | | 4/2002 | Kemp et al. | 81/483 |
| 2002/0139201 A1 | | 10/2002 | Fanguy | 81/483 |
| 2002/0152849 A1 | | 10/2002 | Jenkins | 81/483 |

* cited by examiner

*Primary Examiner*—Lee D. Wilson
*Assistant Examiner*—Alvin J. Grant
(74) *Attorney, Agent, or Firm*—Seyfarth Shaw LLP

(57) ABSTRACT

A manually operated torque wrench is capable of providing a finite plurality of selectable torque values. The torque wrench has a wrench head, a handle, and a torque-responsive mechanism for producing an indication when a torque value has been applied by the torque wrench. A selector in operable communication with the torque measuring mechanism and adapted to set the torque measuring mechanism to one of a finite plurality of predetermined selectable torque value is provided. A retaining mechanism positively retains the selector when one of the selectable torque values is selected.

19 Claims, 4 Drawing Sheets

TORQUE WRENCH WITH FINITE PLURALITY OF SELECTABLE TORQUE VALUES

BACKGROUND

The present application relates generally to hand operated torque wrenches and, more particularly, to torque wrenches with the ability of selecting a torque value from a finite plurality of preset values.

Torque wrenches are generally used by workers to ensure that the correct amount of torque is applied to a fastener or other torqueable device. Threaded fasteners and the like are frequently used in torque-sensitive applications, thus making it imperative that the correct amount of torque is applied. Otherwise, fatigue failure, thread stripping, damage to fastened parts, and the like, can result.

Torque wrenches, either mechanical or electronic, typically combine a wrench head, such as a ratcheting-type head with a drive lug extension, a lever, a handle, and a torque-responsive mechanism which typically conveys an audible, visible or tactile response once a desired amount of torque has been applied and/or provides an indication of the amount of torque applied.

Such torque wrenches are generally of two types—preset (or fixed) and adjustable. Preset torque wrenches provide an indication when a single, fixed amount of torque is reached with no ability for the user to modify the preset, fixed torque value. Preset torque wrenches are generally preferred in areas where, for example, a manufacturer designates a specific amount of torque for sensitive, often repetitive, applications. To ensure that the user meets such torque specifications, a fixed, nonadjustable preset torque wrench is preferred. However, the usability of such a torque wrench is limited because it can only be used for the single, fixed torque value, thus requiring the user to maintain a plurality of different preset torque wrenches if, for example, a certain machine requires differing amounts of torque for different fasteners.

Adjustable torque wrenches, on the other hand, allow the user to incrementally modify the torque value, for example between 20–200 ft-lbs. A selector mechanism may be provided, generally with a graduated torque value scale, such as a micrometer-type scale, to allow the user to approximately select the desired output torque value, whereupon the torque-responsive mechanism is accordingly adjusted. The scope of use of such torque wrenches is greater than fixed, preset torque wrenches because the ability of varying the torque value allows use on many different torque sensitive applications. However, potential user error in selecting the correct torque amount for a certain task is greatly increased due to misreading or inherent inaccuracies of the selector or accidental movement of the selector from the desired torque value.

SUMMARY

The present application discloses improvements in torque wrenches with the ability of selecting among a finite plurality of preset torque values while maintaining control over the output torque values available to the user. The torque wrench of the present application combines the benefits of a conventional preset, fixed-type torque wrench, where the fixed torque value cannot be changed, with the ability of allowing the user to select such preset torque values. For example, if a machine has fasteners with respective 50.5, 72, and 100.2 ft-lbs torque requirements, the improvements of the present application will allow a single torque wrench to be selectable with 50.5, 72, and 100.2 ft-lbs, while still accurately controlling the torque values which can be selected.

The present application also discloses an improved selector mechanism to be used with a manually operated torque wrench. The selector may comprise a rotatable knob in operable communication with a torque-responsive mechanism, which in turn produces an indication when a specific torque value has been applied by the torque wrench. The selector may comprise a key engageable with a plurality keyways, each keyway positioned to correspond to a representative torque value.

Furthermore, the present application may incorporate a positive retaining mechanism to ensure that a correct preset value is properly selected thereby further reducing the chance of erroneous torque selection.

BRIEF DESCRIPTION OF THE DRAWINGS

For the purpose of facilitating an understanding of the subject matter sought to be protected, there is illustrated in the accompanying drawings an embodiment thereof, from an inspection of which, when considered in connection with the following description, the subject matter sought to be protected, its construction and operation, and many of its advantages, should be readily understood and appreciated.

DETAILED DESCRIPTION

There is disclosed herein an improved torque wrench having the ability of selecting a torque value from a finite plurality of preset torque values to activate a torque-responsive mechanism. As such, the wrench of the present application has the benefits of allowing the user to select a preset torque value from among only a limited number and amounts of torque values. The disclosed wrench also inhibits accidental deselection of the selected torque value.

Figure 1:
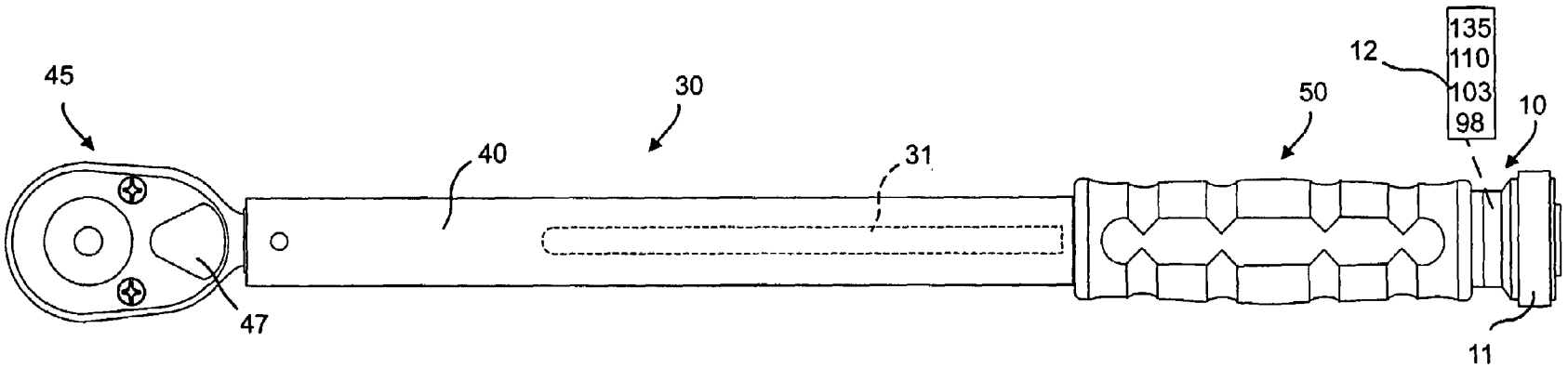
FIG. 1 is a top plan view of a manually operated torque wrench incorporating an embodiment of the selector of the present application.
Figure 2:
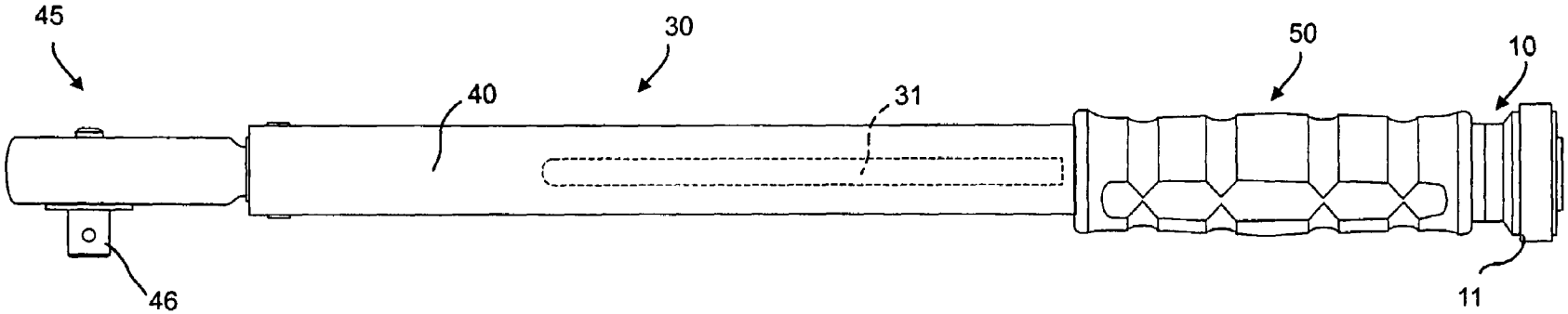
FIG. 2 is a side elevation view of the wrench of FIG. 1.

Referring to FIGS. 1 and 2, a conventional torque wrench 30 having a wrench head 45, a lever 40 and a handle 50 is shown. The wrench head 45 is depicted as a ratcheting-type head with a drive lug extension 46. It will be appreciated that the present application can be used with any type of wrench head.

The torque wrench 30 may have a hollowed interior portion containing a torque-responsive mechanism 31 which may generate an audible, tactile and/or visible response once a designated torque has been applied to the lever. Such a torque wrench 30 is well-known in the art.

Figure 3:
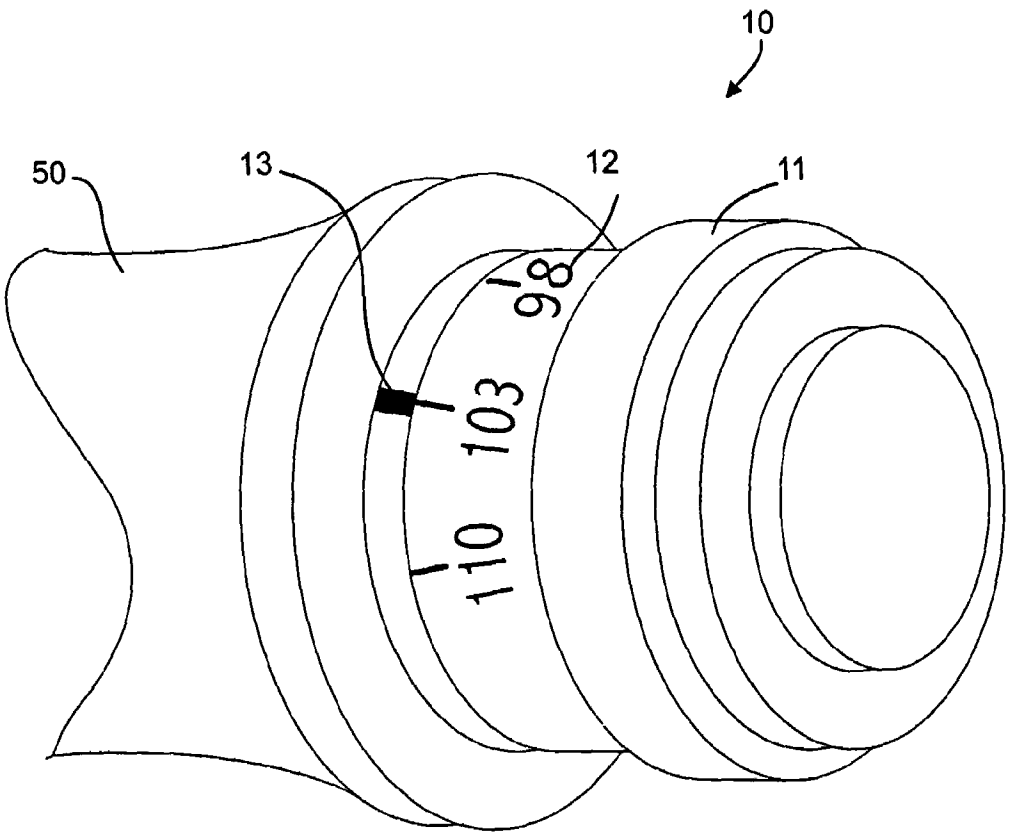
FIG. 3 is an enlarged, fragmentary, perspective view of the selector of FIG. 1.

There will now be described the improved method and apparatus for selecting at least one torque value from a finite plurality of predetermined torque values. Referring also to FIG. 3, a selector mechanism 10 may be disposed on the distal end of the handle 50. The selector mechanism 10 is in operable communication with the internal torque-responsive mechanism and is thus adapted to translate at least one finite, predetermined torque value which will ultimately activate the torque-responsive mechanism. The selector mechanism 10 may comprise an ergonomically shaped knob portion 11 which is rotateable relative to the handle 50. The selector mechanism 10 may further comprise a plurality of markings 12 in the form of numerical representations correlating to the available predetermined torque values which are selectable by the user. A reference marking 13 may be disposed on the handle 50 wherein each of the markings 12 is rotatably alignable with the reference marking 13 when the desired torque value is selected, thus illustrating the desired output torque value which will activate the torque-responsive mechanism.

While the present application is depicted as a rotatable selector adapted to a mechanical torque wrench, it will be appreciated that the selector may comprise many different forms, including, but not limited to, a selector on an electronic torque wrench, i.e., one having electronic torque measuring and/or torque-responsive means, while not departing from the true scope and spirit of the disclosure herein. Further, it will be appreciated that the selector of the present application is not limited to any particular available torque range and that the range depicted in the figures is for illustrative purposes only.

Figure 4:
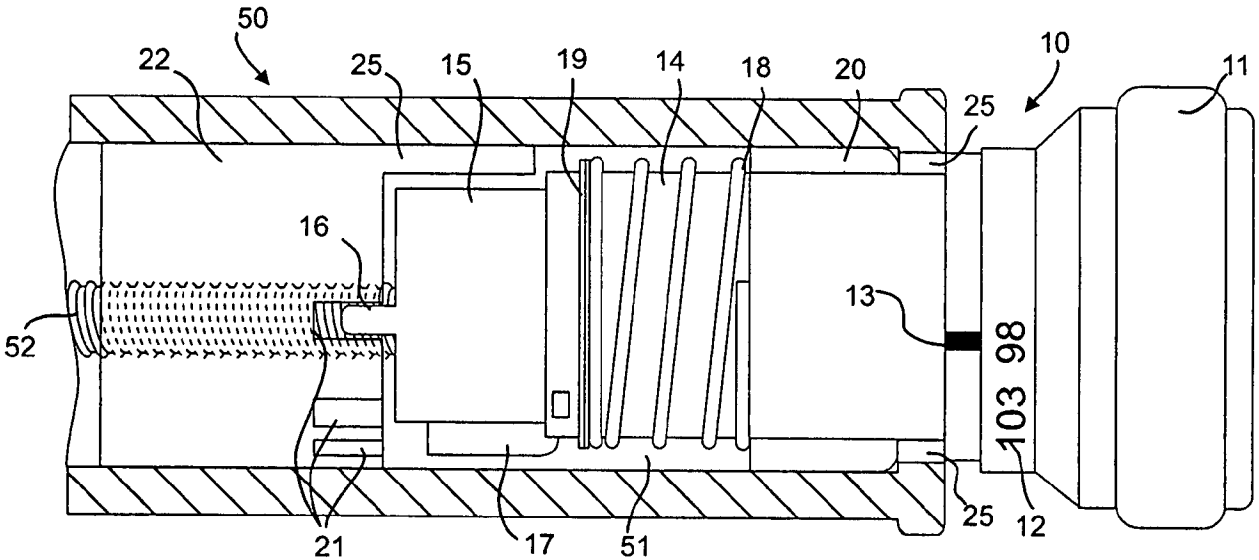
FIG. 4 is an enlarged, fragmentary, detailed cross-sectional view of the selector of FIG. 1 depicting key engagement with a keyway.
Figure 5:
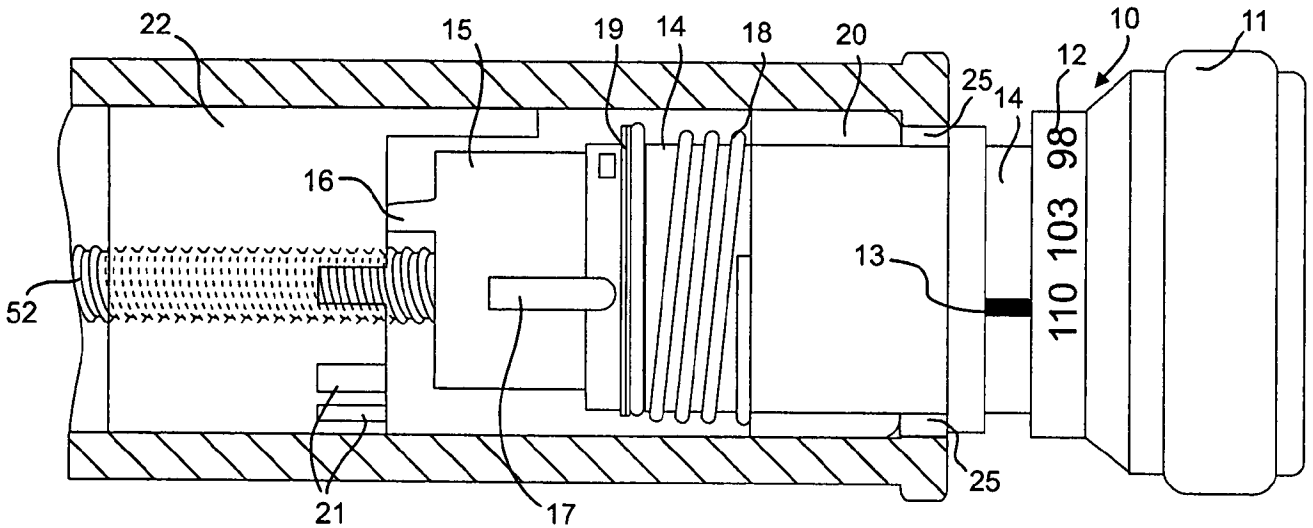
FIG. 5 is a cross-sectional view of the selector of FIG. 4 depicting the key disengaged from a keyway.
Figure 6:
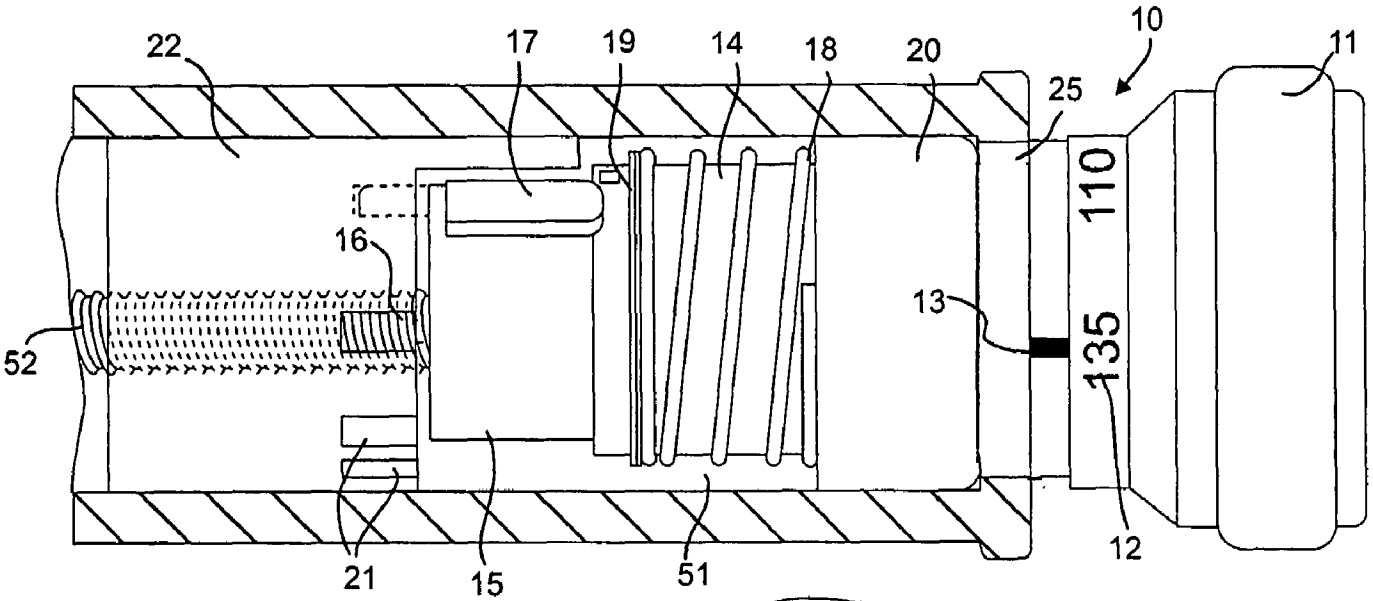
FIG. 6 is a side view of the selector of FIG. 4 with a portion of the handle removed for clarity and depicting key engagement with a different keyway.
Figure 7:
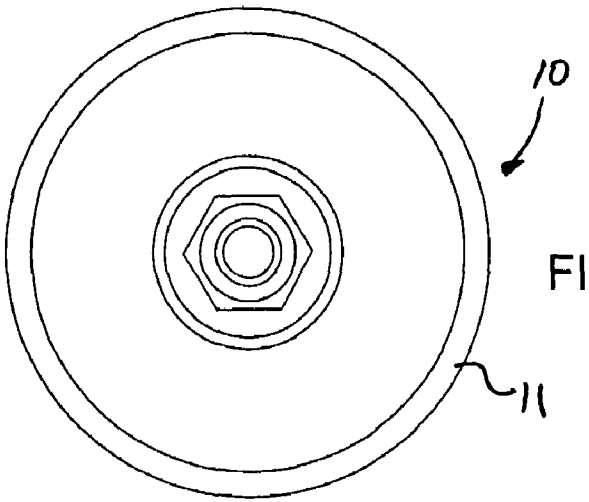
FIG. 7 is an end view of the selector of FIG. 4.

Referring to FIGS. 4–6, the handle 50 has an internal cavity 51 having an internal wall. An axially aligned opening 25 is disposed on the distal end of the handle 50 and communicates with the cavity 51.

The selector mechanism 10 of the present application may comprise an elongated shaft 14 having first and second ends. The shaft 14 is sized and shaped to be slideably received within the opening and cavity 51. The knob 11 is integral with the first end and is configured and shaped with a gripping portion for hand-actuated rotation of the shaft 14 relative to the handle 50. The knob 11 may have a diameter greater than the opening 25 to limit the depth of insertion of the shaft 14 when the shaft 14 is inserted into the cavity 51 via the opening 25.

The second end of the shaft 14 has a key portion 15 having at least one key 16 extending axially therefrom. The key portion 15 is in operable communication with the torque-responsive mechanism 31 via a centrally disposed threaded stud 52 extending axially therefrom relative to the shaft 14. Thus, it will be appreciated that, when the knob 11 is pulled outwardly from the handle and rotated, the shaft 14, key portion 15 and threaded stud 52 are correspondingly rotated, thereby setting the torque value of torque-responsive mechanism. As such, if a user desires to modify the torque value which will set the torque-responsive mechanism, the user outwardly pulls and rotates the knob 11 in the desired direction.

A locking structure 22 is disposed adjacent to the key portion 15 and is attached to the inner wall of the cavity 51 and fixed relative thereto. The locking structure 22 may comprise a plurality of keyways 21 for retainable engagement with the key 16. Each keyway 21 is positioned on the locking structure 22 to correspond to a known torque value when the shaft 14 is rotated relative thereto thereby retainably engaging the key 16 with the respective keyway 21, as illustrated in FIG. 4. When the key 16 is retainably engaged with a keyway 21, the reference marking 13 is aligned with a marking 12 representing the numerical designation of the output torque value of the respective keyway 21 which is engaged by the key 16.

A biasing mechanism may be provided to urge the key 16 to retainably engage in a selected keyway 21. In an embodiment, the biasing mechanism may comprise an annular groove disposed adjacent to the key portion with a collar 19 disposed therein. A shaft collar 20, having an inner diameter sized to slideably receive the shaft 14, may also be fixedly attached to the inner wall of the cavity 51 adjacent to the opening. A helical compression spring 18 may be circumferentially disposed around the shaft 14 and between the collar 19 and shaft collar 20, thereby biasing the key 16 toward the locking structure 22 to retainably engage a selected keyway 21 representing a desired torque value.

A stopping structure may be provided to limit the extent of rotation of the shaft 14 relative to the locking structure 22. A stop 17 may be disposed on the key portion 15 and a leg 25 may be disposed on the locking structure 22 within the rotational path of the stop 17, thereby defining the rotational limits of the shaft 14, as illustrated in FIG. 6.

Selection of a finite, selectable torque value occurs by pulling the knob 11 axially outward from the handle 50, thereby compressing the compression spring 18 and disengaging the shaft 14 from the locking structure 22. Rotation of the knob 11, shaft 14, and key 16 may then occur until the key 16 is aligned with the keyway 21 representing the desired torque value 21, whereupon the knob 11 can be released and the knob 11, shaft 14, and key 16 will return to their normal selected condition retained in the respective keyway 21. The number and amount of available torque values is ultimately determined by the number and placement of available keyways 16 disposed on the locking structure 22.

A method of selecting a preset torque value of a torque wrench having a wrench head, a handle with a distal end, and a torque-responsive mechanism for producing an indication when a torque value has been applied by the torque wrench is also provided. The method comprises providing a selector having a plurality of markings respectively representing one of a finite plurality of predetermined selectable torque values, using the selector to select a preset torque value, and retaining the selector at the selected torque value. The method may also comprise actuating the selector to one of the selectable torque values until the retaining mechanism positively selects one of the selectable torque values. The method may further comprise biasing the selector to a retained position.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

We claim:

1. A torque wrench comprising:

a wrench head;

a handle with a distal end;

a torque-responsive mechanism for producing an indication when a torque value has been applied by the torque wrench;

a selector being in operable communication with the torque-responsive mechanism and adapted for movement to a selected condition to set the torque-responsive mechanism to any one of only a finite plurality of predetermined selectable torque values;

a retaining mechanism for positively retaining the selector in its selected condition when one of the selectable torque values is selected and;

an urging mechanism for urging the selector to any one of the predetermined selectable torque values.

2. The torque wrench of claim 1 wherein the urging mechanism includes a spring.

3. The torque wrench of claim 1 wherein the selector includes a knob rotatably attached to the distal end of the handle.

4. The torque wrench of claim 1 wherein the selector provides a tactile response to a user when moved to a selected condition.

5. The torque wrench of claim 1 wherein the selector further includes a plurality of markings, each marking being representative of at least one respective selectable torque value.

6. The torque wrench of claim 5 wherein each marking is alignable with a fixed reference marking when the selector selects one selectable torque value.

7. The torque wrench of claim 1 wherein the retaining mechanism includes a key for positively engaging a keyway.

8. A selector for selecting one of a finite plurality of selectable torque values of a torque wrench having a wrench head, a handle with a distal end and an opening communicating with a cavity in the handle which has an inner wall, and a torque-responsive mechanism for producing an indication when a selected torque value is reached, the selector comprising:

an elongated shaft having first and second ends, the first end having a knob with a gripping portion and a diameter greater than that of the opening, the second end having an engagement portion, the shaft having a diameter and shape to be slideably received by the opening, wherein the knob is rotatable relative to the handle and accessible to a user when the shaft is disposed in the opening;

a key portion having at least one key disposed on the engagement portion of the shaft and extending in an axial direction therefrom, the key portion being in operable communication with the torque-responsive mechanism;

a locking structure fixedly attached to the cavity inner wall adjacent to the key portion and having a plurality of keyways for retainable engagement with the key, each keyway being positioned on the locking structure to correspond to a different torque value which activates the torque-responsive mechanism when the key is retainably engaged therewith; and a biasing mechanism to urge the key to retainably engage a selected keyway.

9. The selector as claimed in claim 8 wherein the handle has a fixed reference mark disposed adjacent to the knob.

10. The selector as claimed in claim 9 wherein the knob further includes a finite plurality of selectable makings, each marking rotating a respective torque value and being alignable with the reference mark when the key is retainably engaged with at least one keyway.

11. The selector as claimed in claim 8 wherein the shaft further includes an annular groove disposed adjacent to the key portion, the annular groove having a collar disposed therein.

12. The selector as claimed in claim 11 wherein the cavity further includes a shaft collar fixedly attached to the cavity wall adjacent to the opening and having an inner diameter sized to slideably receive the shaft.

13. The selector as claimed in claim 12 wherein the biasing mechanism includes a compression spring circumferentially disposed around the shaft between the collar and the shaft collar whereby the compression spring biases the key to retainably engage a selected keyway.

14. A mechanical torque wrench comprising:

a wrench head;

a handle with a distal end;

a torque-responsive mechanism;

a selector means having a plurality of markings for respectively designating a finite plurality of selectable torque values and being in operable communication with the torque-responsive mechanism;

a retaining means for retaining the position of the selector means; and an urging mechanism for urging the selector means to only one of the selectable torque values.

15. The torque wrench of claim 14 wherein the retaining means includes a retaining mechanism for positively retaining the selector means on a selected torque value.

16. The torque wrench of claim 14 wherein the selector means includes a knob rotatably attached to the distal end of the handle.

17. A method of selecting a preset torque value of a torque wrench having a wrench head, a handle with a distal end, and a torque-responsive mechanism for producing an indication when a torque value has been applied by the torque wrench, the method comprising:

providing a selector having a plurality of markings respectively representing one of a finite plurality of predetermined selectable torque values;

using the selector to select a preset torque value;

biasing the selector to the preset torque value; and retaining the selector at the selected torque value.

18. The method as claimed in claim 17 further comprising actuating the selector to one of the selectable torque values until the retaining mechanism positively selects one of the selectable torque values.

19. A torque wrench comprising:

a wrench head;

a handle with a distal end;

a torque-responsive mechanism or producing an indication when a torque value has been applied by the torque wrench;

a selector for selecting only one of a finite plurality of preset torque values and being in operable communication with the torque-responsive mechanism for modifying the torque value which produce the indication; and an urging mechanism for urging the selector to any one of the present torque values.

* * * * *

UNITED STATES PATENT AND TRADEMARK OFFICE

CERTIFICATE OF CORRECTION

PATENT NO. : 6,945,144 B1
DATED : September 20, 2005
INVENTOR(S) : Brian Cutler et al.

It is certified that error appears in the above-identified patent and that said Letters Patent is hereby corrected as shown below:

Column 5,
Line 58, “makings” should be -- markings --.

Column 6,
Line 50, “or” should be -- for --.
Line 59, “present” should be -- preset --.

Signed and Sealed this

Twenty-second Day of November, 2005

JON W. DUDAS
*Director of the United States Patent and Trademark Office*